US006279258B1

(12) United States Patent
Hashman

(10) Patent No.: US 6,279,258 B1
(45) Date of Patent: Aug. 28, 2001

(54) SHORT BOLT RIFLE

(76) Inventor: James Hashman, P.O. Box 874542, Wasilla, AK (US) 99687

( * ) Notice: Subject to any disclaimer, the term of this patent is extended or adjusted under 35 U.S.C. 154(b) by 0 days.

(21) Appl. No.: 09/397,426

(22) Filed: Sep. 17, 1999

(51) Int. Cl.[7] ..... F41A 3/00; F41C 7/00
(52) U.S. Cl. ..... 42/16
(58) Field of Search ..... 42/16, 14; 89/22, 89/24, 180, 185

(56) References Cited

U.S. PATENT DOCUMENTS

| | | | | |
|---|---|---|---|---|
| 550,602 | * | 12/1895 | Driggs | 89/22 |
| 2,811,902 | * | 11/1957 | Dixon | 89/165 |
| 3,776,095 | * | 12/1973 | Atchisson | 89/128 |
| 4,672,762 | * | 6/1987 | Nilsson | 42/70.01 |
| 5,148,619 | * | 9/1992 | Badali | 42/16 |
| 5,659,992 | * | 8/1997 | Msitretta | 42/23 |

* cited by examiner

*Primary Examiner*—Michael J. Carone
*Assistant Examiner*—Michelle Thomson
(74) *Attorney, Agent, or Firm*—Michael J. Tavella

(57) ABSTRACT

A short bolt rifle that enables increased barrel without an increase in weight. A longer barrel increases bullet velocity, which increases the range and accuracy of the weapon and the bullet impact energy. In this action, the bolt is simply pulled back and pushed forward. The design includes a loader mechanism that ejects spent cartridges and loads a new cartridge. This happens while the bolt is drawn back and pushed forward. A rotating lock secures the bolt in the firing position. A second version of the action uses a pistol grip. A lock holds the pistol grip, which can be released. After it is released, the user pulls down and back on the grip to open the action. The grip is pushed forward and upward, to load a shell, while the bolt is moved forward and locked. The action also can easily be adapted to fully automatic operation.

10 Claims, 14 Drawing Sheets

SHORT BOLT RIFLE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to bolt operated rifles and particularly to short bolt operated rifles.

2. Description of Related Art

For years, the Mauser operated rifle has been the standard firing mechanism for civilian hunting weapons. This rifle has an action that is simple to operate and reliable to use. Despite these advantages, it has some drawbacks. First, the action uses a long bolt. The length of the bolt forces the barrel to be shorter than it could be. This is due to weight and overall length of the rifles. The second drawback is the operation of the bolt. In this action, the bolt has a small handle. The handle must be rotated between 60 and 90 degrees, then pulled back the full length of the bolt to load a shell in the chamber. Then the bolt must be pushed all the way back into the firing position. Finally, the bolt handle must be rotated back between 60 and 90 degrees to lock the bolt in place for firing. These movements were designed to prevent gun jamming. Because the Mauser was designed as a military weapon, troops under fire often caused gun jamming by moving the action too quickly. The Mauser design prevented this by making the user slow down the action. Since then, military weapons have become fully automatic, and the need for the Mauser action has disappeared. The action has survived in civilian rifles, however.

Since the invention of the Mauser action, other efforts have been made to improve the speed and efficiency of this action. Some examples are found in U.S. Patents. For example, U.S. Pat. No. 3,270,456 teaches an improved breech bolt mechanism. U.S. Pat. No. 3,257,749 teaches a straight pull bolt action rifle that uses a pivoting handle and a cross pin to release the bolt, unlike actions that turn the bolt to release it. U.S. Pat. No. 4,547,988 teaches a bolt locking system that uses lugs and grooves to lock the bolt in place. U.S. Pat. No. 5,440,963 teaches a double barrel bolt design. U.S. Pat. No. 4,723,369 teaches a system whereby the bolt diameter is reduced when used in a short throw action. Finally, U.S. Pat. No. 4,920,677 teaches a non-rotating bolt. Despite the differences between them, all these patents have one thing in common-a full-length bolt. Full-length bolts have been used since the first bolt action rifle was invented.

BRIEF SUMMARY OF THE INVENTION

Unlike the patents discussed above, the instant invention is a rifle that has a short bolt. Using the short bolt enables the barrel length to be increased. Increasing the barrel length increases the velocity of the bullet. For example, in a typical rifle, such as the Remington 7 mm magnum model 700, the overall length is 44.5 inches. This rifle has a 24-inch barrel and a 7⅜ inch bolt. If the bolt length was reduced from the 7⅜ inches to 1⅜ inches, the barrel could be increased from 24 inches to 30 inches with no increase in weight. The increase in bullet velocity coming from the longer barrel length increases both the range and accuracy of the weapon as well as the impact energy of the bullet.

The short bolt design is also easier to operate. Instead of having to rotate the bolt handle, the bolt handle is simply pulled back and pushed forward. Loading of the cartridges is also simplified. The design includes a loader mechanism that ejects spent cartridges and loads a new cartridge at the same time. All this is done while the bolt is drawn back and pushed forward in one easy motion. The bolt action includes a rotating lock to secure the bolt in the firing position. This lock is released when the bolt catch is rotated out and the lock rotates by sliding along a cam. After the lock is released, the bolt can be pulled back. The process is reversed when the bolt is moved forward.

A second version of the action uses a pistol grip. Here, a lock holding the pistol grip is released. After it is released, the user just pulls down and back on the grip. This causes the bolt to rotate, unlock and withdraw. The spent shell is then ejected. When user then pushes the handle forward and upward, a new shell is loaded, the bolt is seated and locked. The gun is then ready for firing.

A safety mechanism has been designed for each type of action.

This action can easily be adapted to fully automatic actions, such as those used by the military.

BRIEF DESCRIPTION OF THE DRAWINGS

FIG. 9 is a side view of the action showing a shell fully seated in the chamber and the bolt set in place, ready for firing, with the safety on.

FIG. 11 is a side detail view of the invention with the bolt set and the safety on.

FIG. 29 is a side view of the action with the safety on.

DETAILED DESCRIPTION OF THE INVENTION

Figure 1:
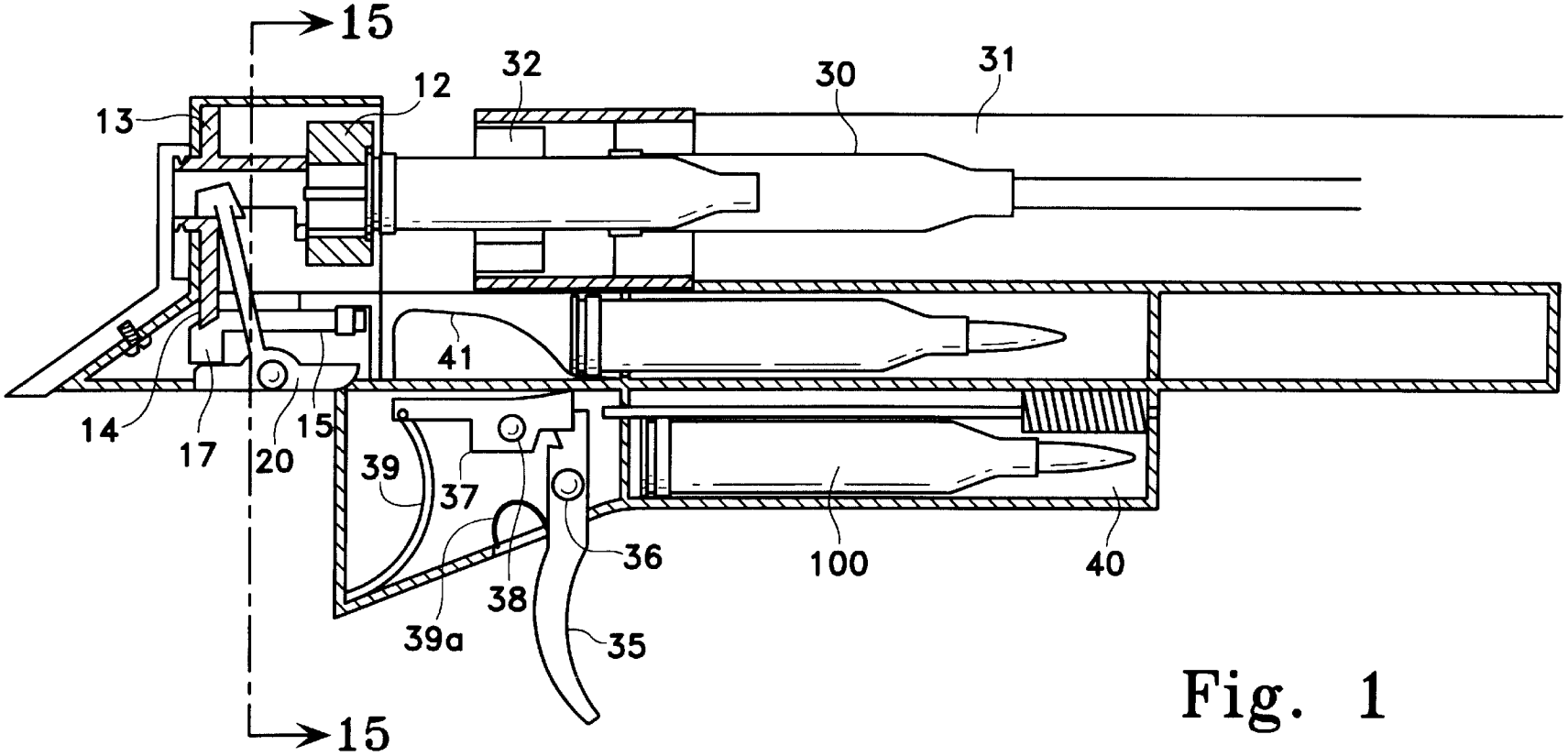
FIG. 1 is a side elevation, cut-away view of the action with the bolt being pulled back after firing and the cartridge being removed.
Figure 2:
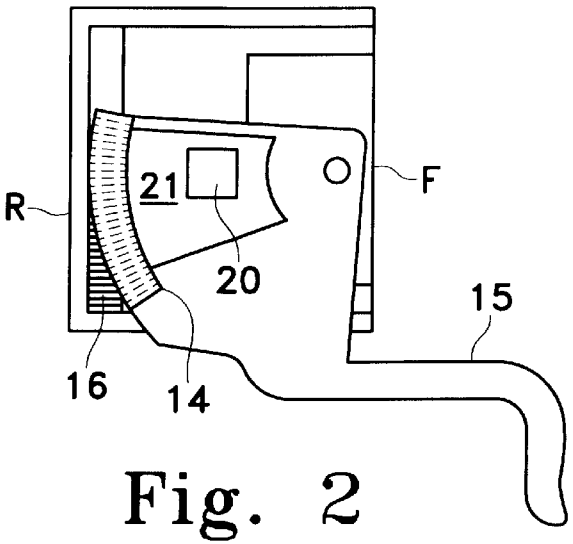
FIG. 2 is a top detail view of the bolt lever in the locked position.
Figure 3:
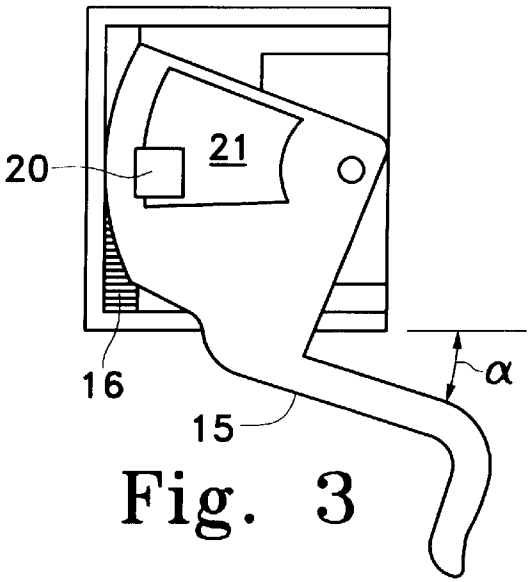
FIG. 3 is a top detail view of the bolt lever rotated 30 degrees, and now in the released position.
Figure 6:
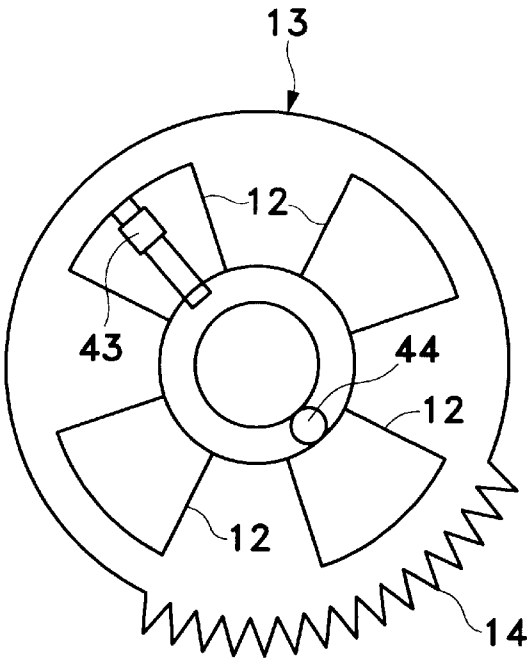
FIG. 6 is a front view of the bolt showing the locations of the ejector and extractor mechanisms.
Figure 4:
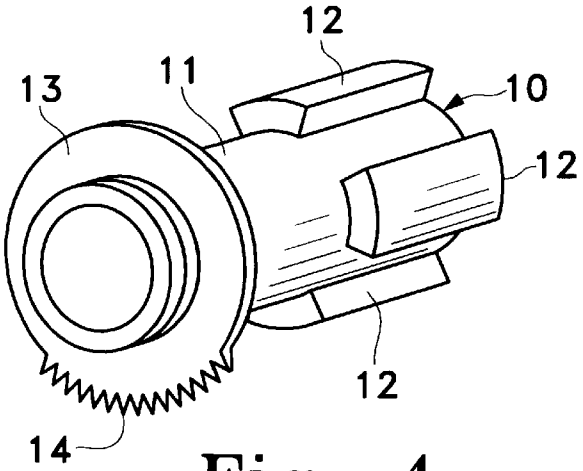
FIG. 4 is a perspective detail view of locking lugs on the bolt.

Referring now to FIG. 1, a side view of my new action is shown. This design is a limited throw, short bolt. Title bolt 10 is approximately 1⅜ inches long. FIG. 4 shows the bolt 10. The bolt 10 has a cylindrical body 11, a number of locking lugs 12, and a rear ring 13. The lower portion of the rear ring 13 has a number of gear teeth 14 as shown. See also FIG. 6. As shown in FIGS. 2 and 3,the bolt is connected to a lever 15 that releases the bolt and is used to lock it in place for firing. Note that in FIGS. 2 and 3, the front of the bolt is marked F and the back of the bolt is marked R. The lever 15 has a set of gear teeth 16 formed on the top of one end as shown. These teeth mesh with a curved set of teeth 14 on the bottom of the rear ring 13 of the bolt See also, FIG. 15.

As shown in FIGS. 2 and 3, the hammer 20 sits in a wide slot 21 and is surrounded by the bolt lever 15. The lever 15 also has a ramp 17 (see FIG. 15). This ramp 17 cocks the hammer 20 when the lever 15 is rotated back. FIG. 3 shows the bolt lever 15 rotated back by an angle $\alpha$. In the preferred embodiment, the angle $\alpha$ is about 30°. This is discussed further, below.

15 is advanced (see FIG. 2) in to the locked position. As the lever is moved forward, the bolt rotates 30 degrees. This rotates the locking lugs 12 until they no longer align with the slots 32. In that position, the bolt cannot be removed or pulled back, effectively locking the bolt in place. After the gun has been fired, the bolt lever 15 is pulled back, which rotates the lugs 12 until that are aligned with the slots 32 at this point, the bolt can be pulled back from the barrel.

FIG. 1 also shows the firing mechanism. A trigger 35 is mounted on a pivot pin 36 as shown. A rocker arm 37 is positioned above the trigger 35 as shown. The rocker arm 37 also pivots on a pin 38. A spring 39 is attached to the rocker arm 37.

The spring 39 is positioned as shown. A second spring 39*a* is also shown. Their use is discussed below.

Figure 7:
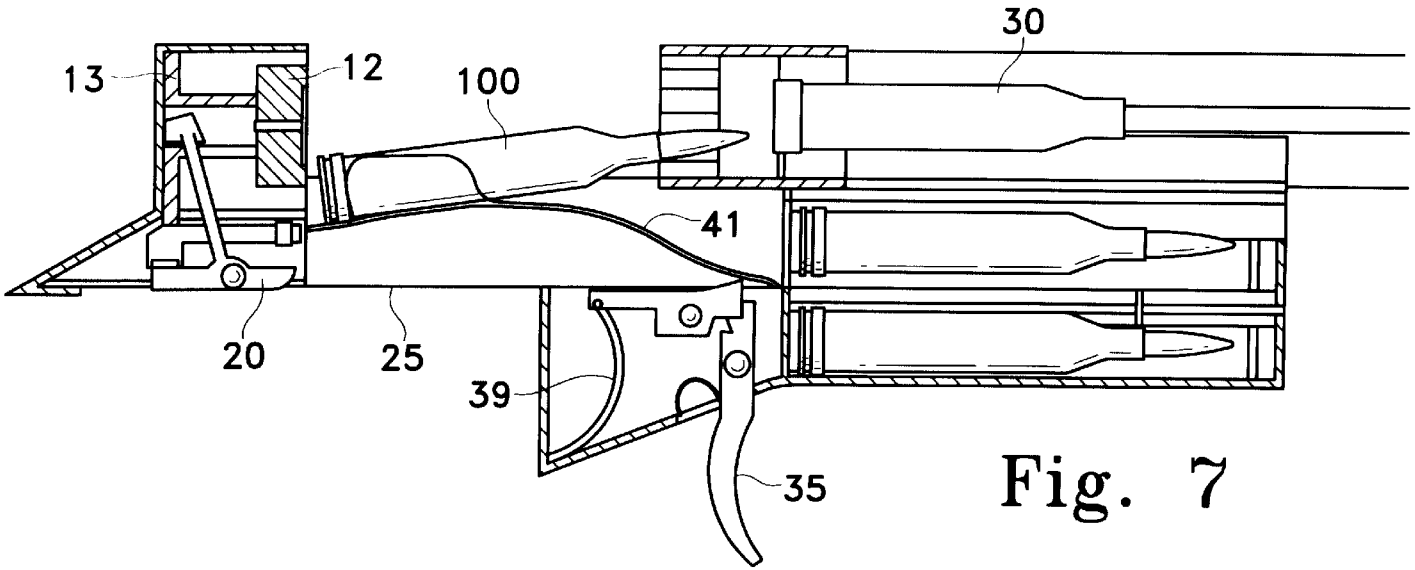
FIG. 7 is a side view of the bolt in position for loading, with a shell in position for entry into the chamber.
Figure 14:
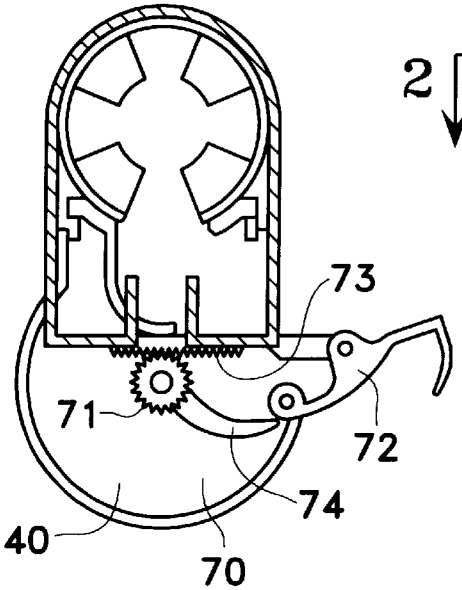
FIG. 14 is an end view of the action taken along the lines 14—14 of FIG. 12.
Figure 13:
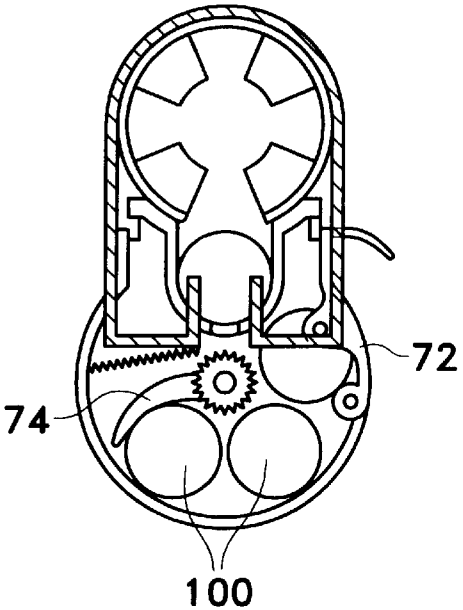
FIG. 13 is an end view of the action taken along lines 13—13 of FIG. 11.

FIG. 1 also shows a magazine 40 that holds additional shells 100. The magazine is also shown in FIGS. 13 and 14, and is discussed in more detail below. Also shown in FIG. 1 is a reloading spring 41. This spring slides under the top shell in the magazine when the bolt is slid forward. When the bolt is retracted, the spring 41 is pulled back. It causes the shell to be pulled back as well. Once the shell clears the magazine, it is pushed up by the spring 41. This is shown in FIG. 7. The shell is then aligned with the barrel so that it can be loaded when the bolt is moved forward.

FIG. 4 shows the bolt 10. It shows the lugs 12, and the gear teeth 14. It also shows the shell extractor 43 and shell ejector 44. These devices are standard components in the industry and are used in the ordinary manner.

Figure 5:
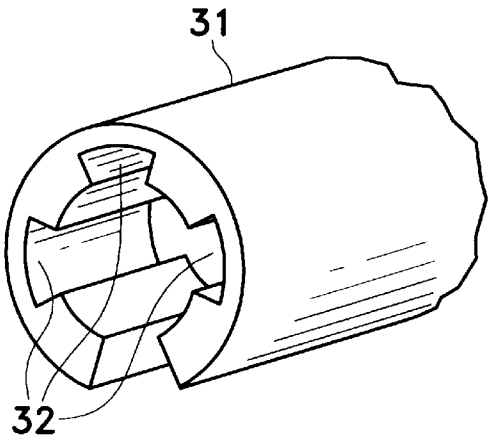
FIG. 5 is a perspective view of the locking lug receptors in the gun barrel.
Figure 15:
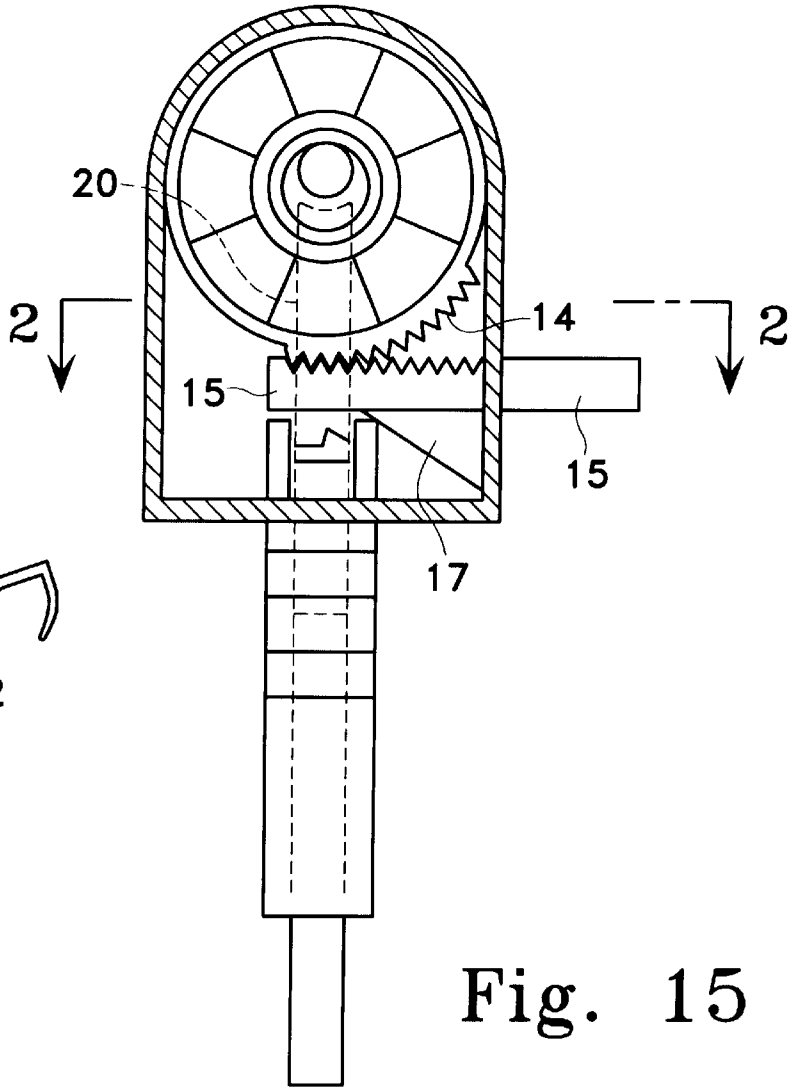
FIG. 15 is a rear end detail view of the rifle action showing the unlocking mechanism.

FIG. 1 shows the action after it has just been fired. The bolt has been released by pulling back on the bolt lever. FIG. 2 shows the bolt lever in the locked position. FIG. 3 shows the bolt lever rotated back 30 degrees, in the unlocked position. As the bolt level is rotated, the gear teeth cause the barrel lugs to rotate. FIG. 15 shows the gears in the locked position. When the lever is fully rotated, the lugs 12 on the bolt (see FIG. 4) are aligned with the slots 32 in the barrel (see FIG. 5) for removal. At this point, the bolt can be pulled straight back. FIG. 1 shows the beginning of this rearward movement.

Figure 8:
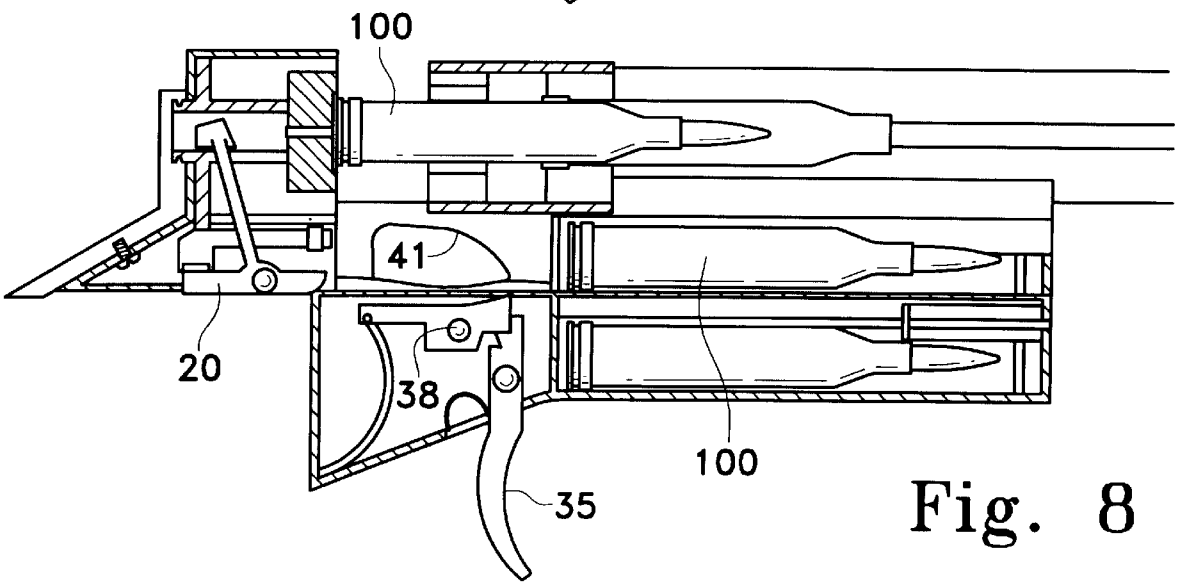
FIG. 8 is a side view of the action with the shell advanced onto the chamber.

As mentioned above, as the bolt is pulled back, a cartridge extractor 43 pulls the spent cartridge from the chamber and an ejector ejects the spent cartridge. As the spent cartridge is ejected, a new cartridge 100 is pulled from the magazine by means of a loading spring 41. This shown in FIG. 7. FIG. 8 shows the bolt in the process of being pushed forward, unloving the new cartridge into the chamber. In FIG. 8, the loading spring 41 is being compressed under the shell in the magazine. When the bolt is fully forward, as shown in FIG. 9, for example, the reloading spring 41 is fully compressed under the shell in the magazine.

When the bolt is fully seated, the bolt lever is rotated forward 30 degrees. This turns the locking lugs into the locked position. This is shown in FIGS. 9 and 15. As shown in FIG. 15, moving the lever forward rotates the bolt counterclockwise. The ramp 17 cocks the hammer for firing, as discussed above. As shown in FIG. 15, when the lever 15 is fully rotated forward, the ramp 17 is clear of the hammer 20. This allows the hammer to move forward when the gun is fired.

Figure 9:
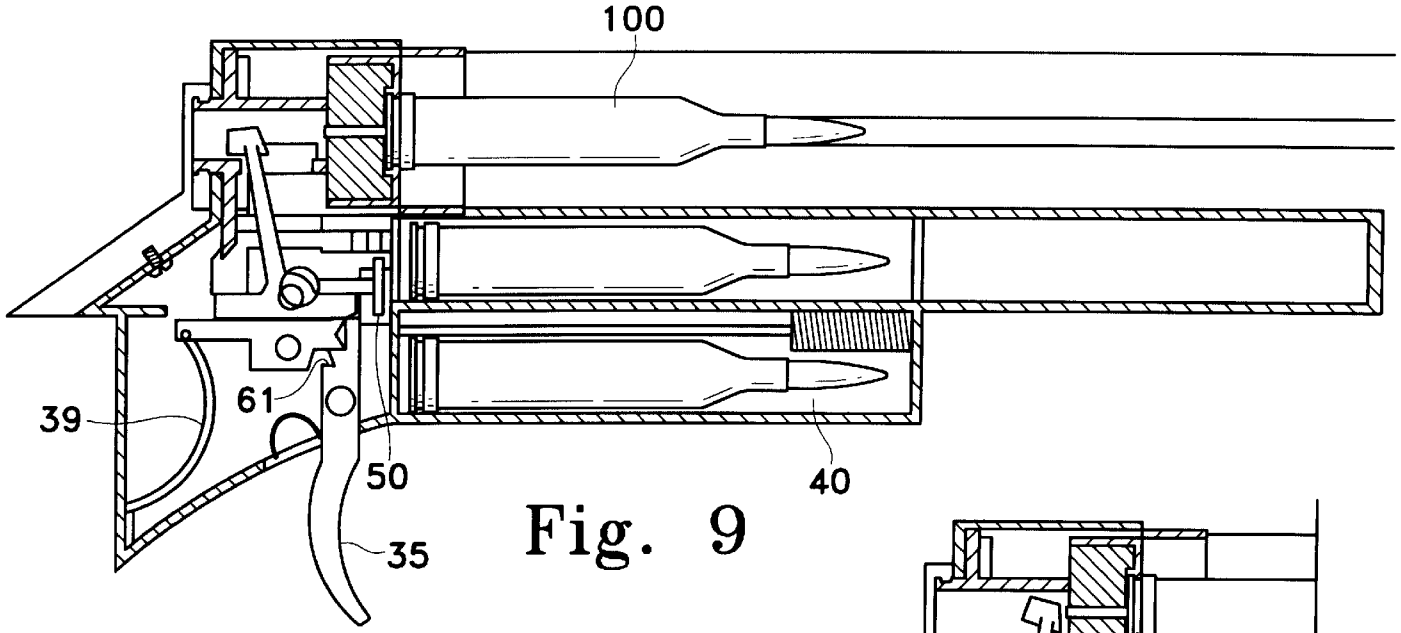

FIG. 9 shows the gun is loaded and ready to fire. However, the gun cannot be fired because the safety latch is on. Moreover, the operational lever is removed from the gun. The safety system is discussed in greater detail below. However, FIG. 9 shows the sliding safety pin 50 in place. When the pin is in this position, the top of the trigger cannot pivot forward to fire the gun.

Figure 17:
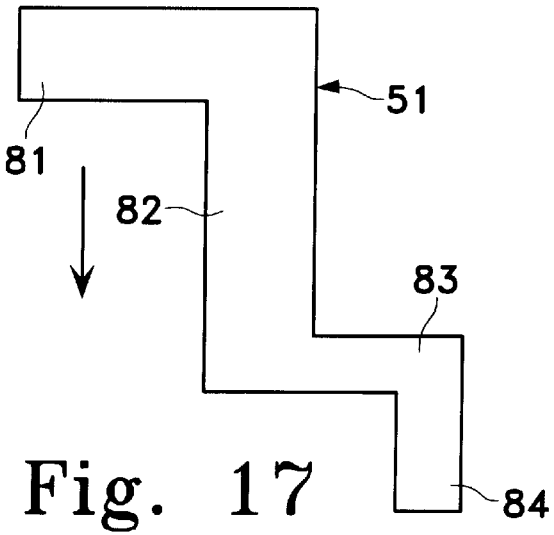
FIG. 17 is a top detail view of a key used with the safety mechanism.

FIG. 17 shows the action after the gun has been fired. This view also shows the safety lever 51 installed and the safety turned off. When the safety lever 51 is in the off position, the safety pin 50 is lifted above the face of the trigger as shown.

Figure 10:
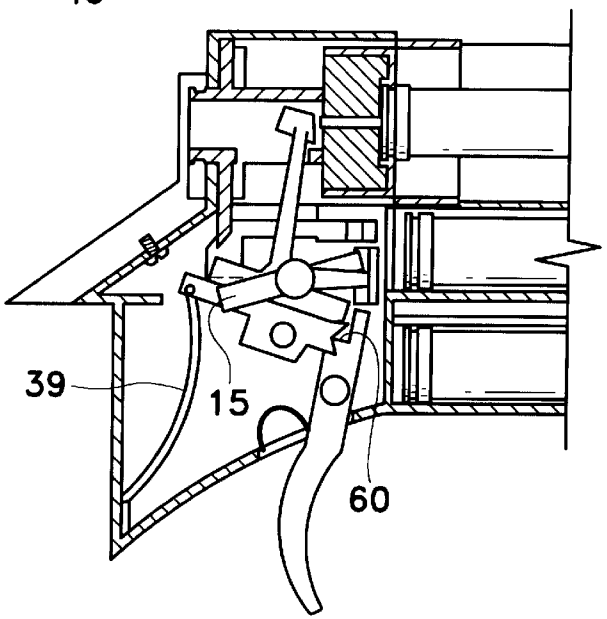
FIG. 10 is a detail view of the hammer at firing, showing the released hammer and the firing pin in contact with the cartridge primer. This view shows the safety off.
Figure 11:
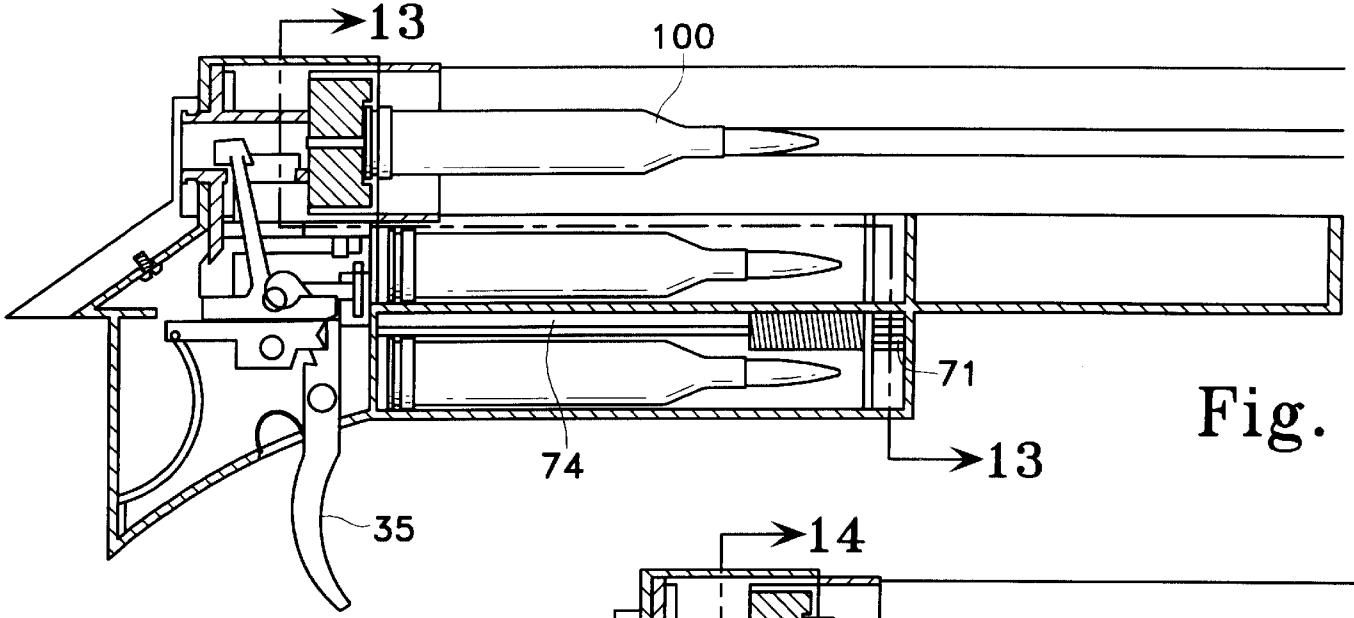
Figure 12:
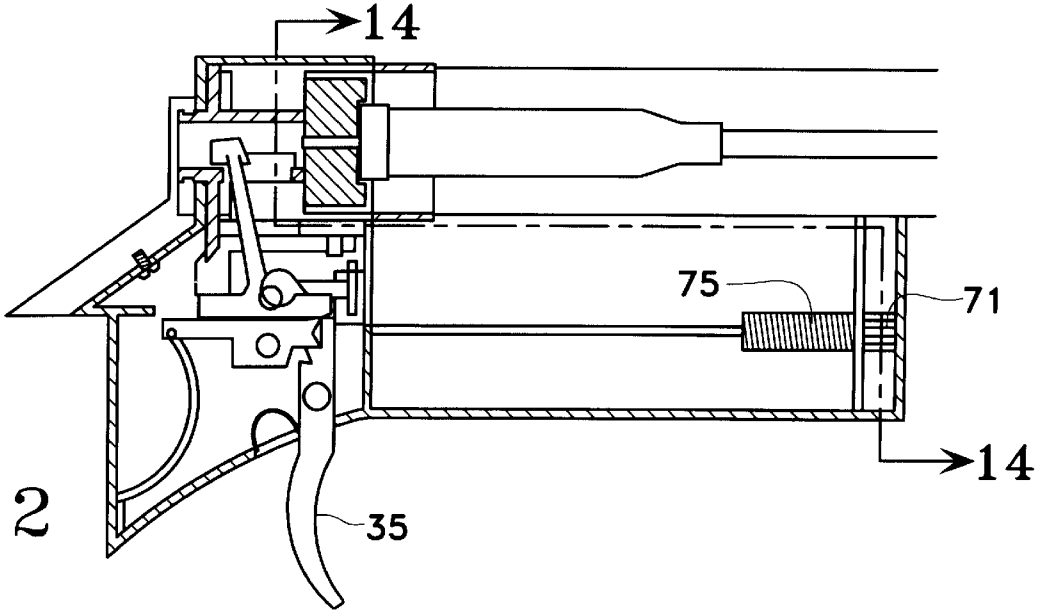
FIG. 12 is a side detail view of the invention with the loading gate open, ready to receive a cartridge into the magazine.

In this position, the trigger can be pulled. As the trigger is pulled back, the top of the trigger is moved forward. Once the top notch 60 clears the bottom of the rocker arm 37, the spring 39 pushes the back of the rocker arm 37 upwards. This pushes the hammer forward against the firing pin, firing the gun. A lower notch 61 is provided on the trigger to catch the front end of the rocker arm 37 to prevent it from falling between the trigger and the spring. FIG. 10 shows the front end of the rocker arm 37 resting in the lower notch 61.

Once fired, the bolt lever is rotated back. As discussed above, rotating the bolt lever does several things. In FIG. 10, one can see how the ramp 17 works to cock the gun. The ramp 17 is sloped as shown in FIG. 15. As the lever 15 is rotated, the ramp pushes against the top of the hammer 20, which is now in the upwardly tilted position. The ramp 17 forces the back of the hammer 20 down until it is fully cocked. Pushing the hammer down forces the rocker arm 37 to compress the spring 39. Eventually, the front of the rocker arm clears the upper notch 60 on the trigger and the action is held in place, ready for firing, as shown, for example, in FIG. 1.

FIGS. 11–14 show details of the magazine. FIG. 14 shows a sectional view through the magazine. There is an open chamber 70 to receive the shells. A gear 71 is used to operate the loading system. A gate 72 is used to open and closed the magazine. The gate 72 runs the length of the magazine.

A sliding gear rack 73 is attached to the gate as shown. When the gate is pulled open, the gear rack 73 engages the gear 71. This gear rotates the loading arm 74. The loading arm 74 runs the length of the magazine. As shown in FIG. 14, the gear 71 is rotates the loading arm to the most rearward position. Now, a number of shells can be loaded into the magazine. When the magazine is full, the gate 72 is closed. Closing the gate moves the gear rack 73 past the gear 71 as shown in FIG. 13. A spring 75 (see FIGS. 13 and 14) provides a counter force on loading arm 74.

The spring tries to force the loading arm 74 back. When the gun is loaded as shown in FIG. 13, the spring cannot move the loading arm because it is blocked by the shells. As a shell is ejected from the gun, however, the spring 75 can push the last shell towards the gate, this aids in moving the first shell into the loading position and ensures that the next shell in line is in position for the next loading operation.

Figure 18:
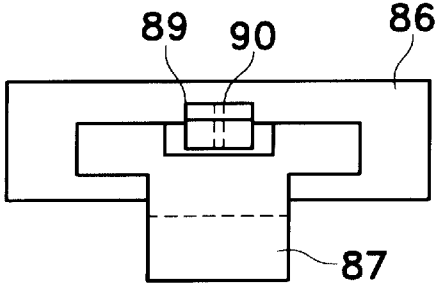
FIG. 18 is a top detail view of the sliding safety mechanism, with the key removed.
Figure 20:
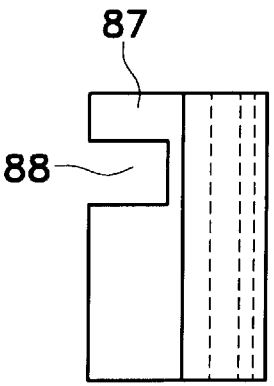
FIG. 20 is a side detail view of the sliding safety mechanism, with the key removed.
Figure 19:
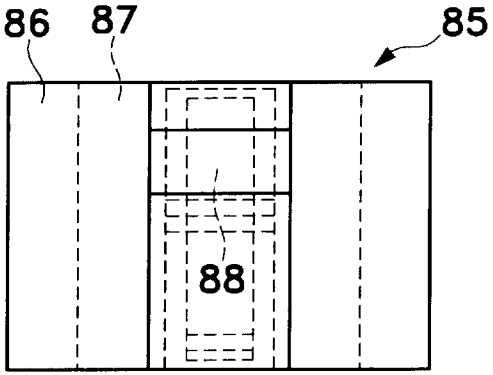
FIG. 19 is a front detail view of the sliding safety mechanism, with the key removed.

FIGS. 16–20 show details of the parts of the safety mechanism. FIGS. 9 and 10 also show details of the safety. FIG. 17 shows the safety lever 51. As shown, the safety lever 51 has a long end 81, a perpendicular shaft 82 a middle portion 83 and an end portion 84. FIGS. 18–20 show the sliding safety mechanism 85. FIG. 18 is a top view of the mechanism. FIG. 19 is a front view of the mechanism and FIG. 20 is a side view of the mechanism. In these views, the safety lever is not shown in place. The safety mechanism has a housing 86 that has a "t" shaped slot formed in it to receive the sliding safety pin 87. The sliding safety pin 87 has a groove 88 formed in the front portion as shown in FIGS. 19 and 20. This groove receives the end portion 84 of the safety lever 51. The safety pin 87 is slid into the housing 86. Housing 86 also has a vertical slot 89 in the back of the housing as shown.

Figure 16:
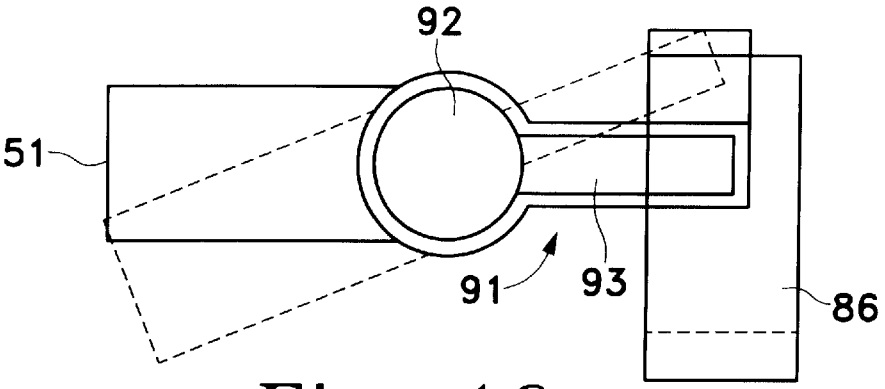
FIG. 16 is a side detail view of the safety mechanism showing both the on position and the off position.

This slot receives a retaining spring 90 that holds the sliding safety pin in place when the safety lever is removed from the mechanism. Otherwise, the pin can drop free of the mechanism if the gun is turned over and the gun can then be fired. The safety mechanism is located in the physical center of the action. It is shown in FIG. 9. The safety system also has a machines key way 91 formed in the action that directs the safety lever into the center of the gun. The key way has a hole 92 and a slot 93. The safety level aligns so that the middle portion 83 of the lever 51 aligns with the slot 93. With this alignment, the safety lever slides into position until the end 84 fits into the groove 88. This direction is shown by the arrow on FIG. 17. When the safety lever is installed, hole 92 acts as a pivot point for the safety lever. The end 81 remains outside the action and is moved by the user to activate the safety. When the safety is on, the safety lever 51 is horizontal and the sliding safety pin is in the on position. In this position, the safety pin extends just past the face of the trigger, preventing the trigger from moving forward. See, FIG. 9. Also, in this position, the safety lever can be removed. When removed (as shown in FIG. 9), the gun is locked and cannot be fired. The spring 90 acts to hold the sliding safety pin in position when the safety lever is removed. Otherwise, it is possible to take the gun off safety by turning the gun over. When the safety lever 51 is in position, it can be rotated as shown in FIG. 16 (to the position shown by the dashed lines). In the rotated position, the lever lifts the sliding safety pin upwards, past the face of the trigger. This is also shown in FIG. 10. Of course, once the safety pin is lifted, the gun can be fired.

Second Embodiment

FIGS. 21–30 show a second embodiment of the invention. In this embodiment, the action is similar to that of the first embodiment except that the bolt lever is incorporated into a pistol grip. This shifts the plane of the bolt lever from the horizontal to the vertical. Despite the different structures, the pistol grip bolt operation does the same things that the bolt lever operation does. First, it rotates the bolt to align the locking lugs for bolt operation. Second, it cocks the hammer to prepare it for firing. Third, it is used to slide the bolt backwards and forwards for the loading and unloading operation. In this embodiment, the bolt and hammer have been modified to accommodate the new mechanisms. These changes are discussed in detail below.

Figure 21:
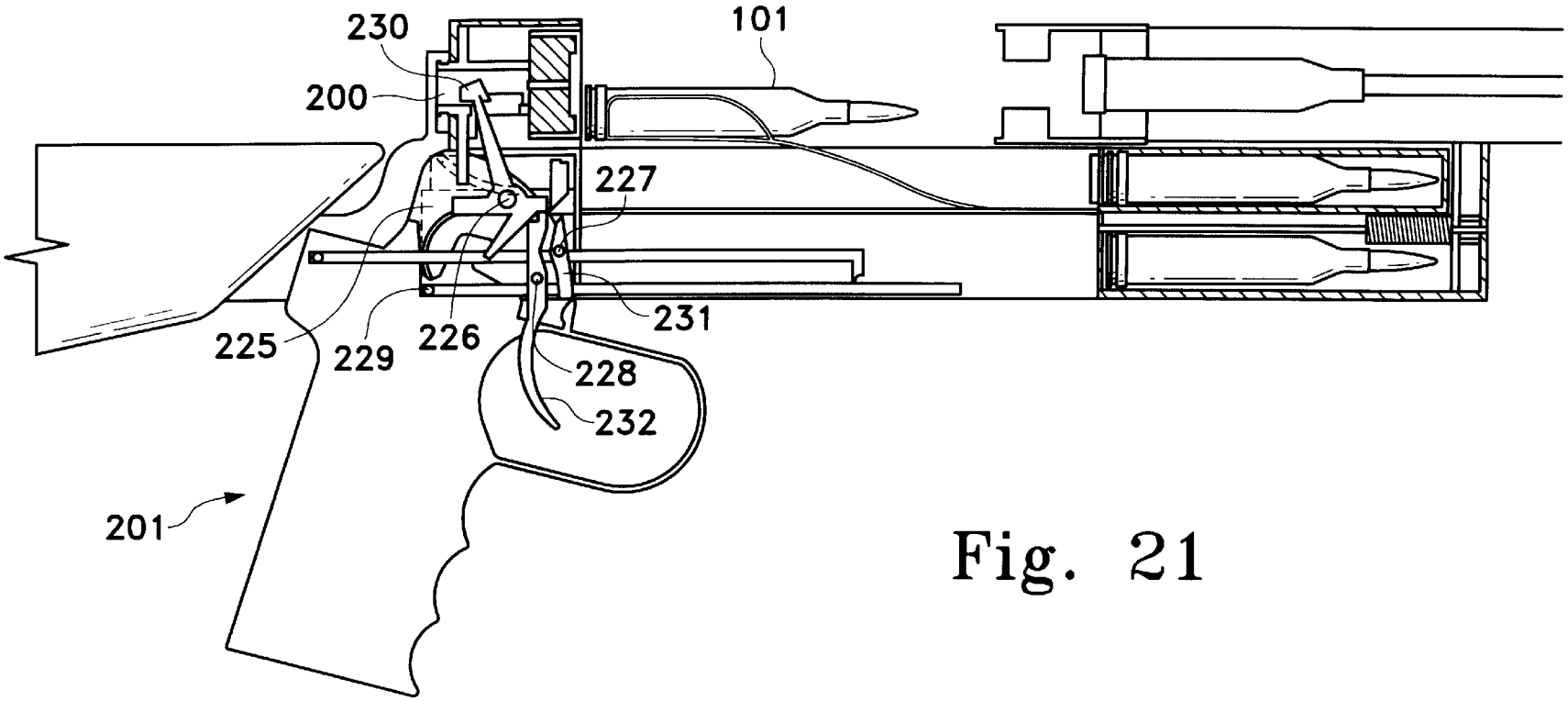
FIG. 21 is a side cut-away view of the second embodiment of the invention showing the bolt open.

FIG. 21 shows the action open. Here, the bolt 200 is pulled back. A cartridge 101 is ready to be loaded into the chamber. As shown in the figure, the pistol grip assembly 201 is rotated back. This backward rotation causes the bolt to turn and be released from the barrel. It also cocks the hammer. These actions are accomplished by the structure of the pistol grip.

Figure 22:
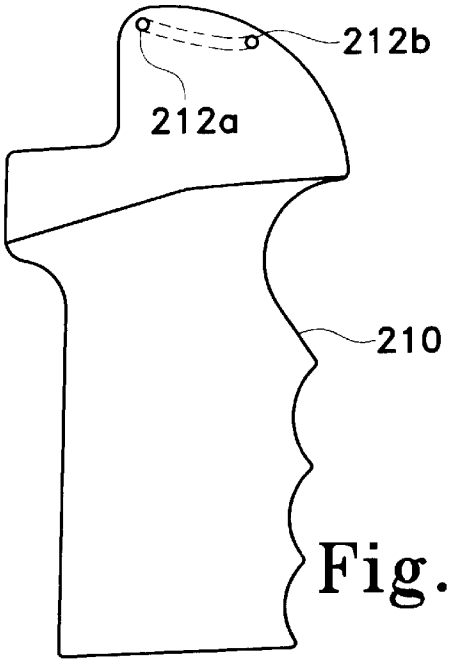
FIG. 22 is a detail view of the center section of the handle of the second embodiment.

The parts of the pistol grip assembly 201 are shown in FIGS. 22–27. FIG. 22 shows the inner grip form 202. The lower portion of the inner grip form 202 has the shape of the pistol grip as shown. This form also has the trigger guard 203 formed as part of it as well. Two holes 204 and 205 are provided. These holes have pins 206 placed in them that fit in guides for the pistol grip when the pistol grip is being opened and pulled back and forth. See, e.g., FIGS. 21 and 24. This mechanism is discussed below. The inner grip form also has a first ear 207 that extends above the trigger guard as shown. This ear engages a locking latch to secure the action for firing. This latch is discussed below. The inner grip form also has a second ear 208 that engages a contact member on the hammer that cocks the hammer. This feature is also discussed below.

Figure 23:
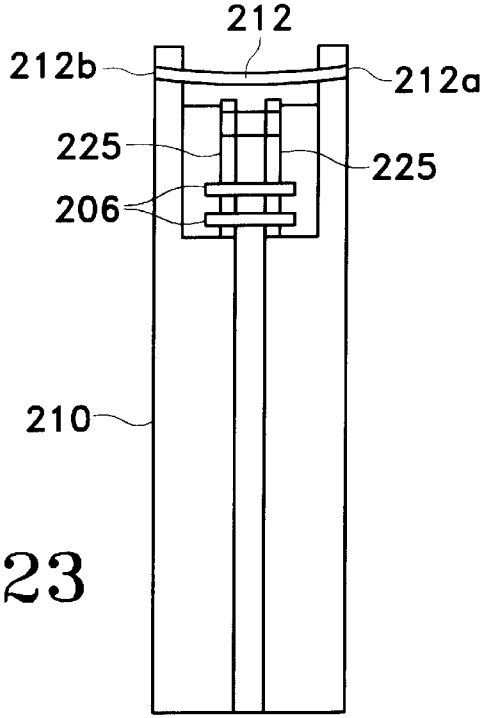
FIG. 23 is a detail view of the side piece of the handle of the second embodiment. The right side piece being a mirror image of the left side piece.
Figure 25:
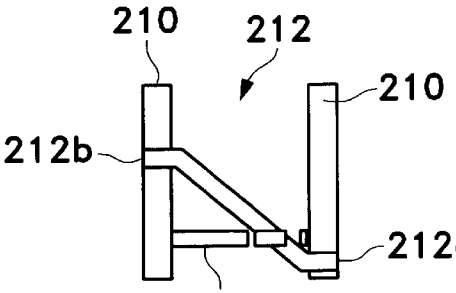
FIG. 25 is top detail view of the cam mechanism in the pistol grip.

FIG. 23 shows an outer grip member 210. Like the inner grip form, the bottom portion of these members have a pistol grip form. Note that FIG. 23 shows two end of a cam 212. FIG. 25 shows a top view of this assembly. This figure shows that the cam 212 is slanted as shown. The cam is anchored at the rear of the right outer form as indicated by the reference numeral 212*a*. The cam is anchored at the front of the left outer form as indicated by reference numeral 212*b*.

Figure 26:
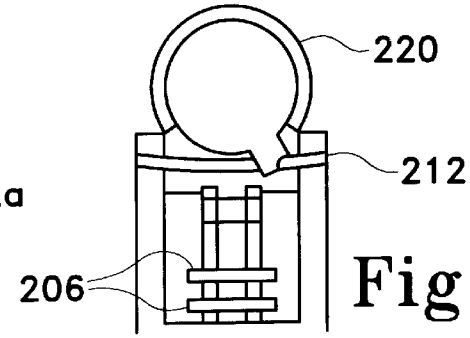
FIG. 26 is a detail view of showing the bolt in contact with the cam, which turns the bolt for release.

FIG. 26 shows the placement of the rear ring 220 of the bolt 200 on the cam 212. Unlike the first embodiment, the bolt in this embodiment does not have a set of gear teeth on the bottom. Rather, it has a cam follower. In the preferred embodiment, the cam follower is a hole in the extended portion of the bolt ring as shown. The cam passes through this hole and is held in place. As shown in FIGS. 25 and 26, As the pistol grip is pulled down, the bolt ring follows the cam. FIG. 26 shows that the cam ring is at an angle in the closed position. As the handle is rotated, the bolt ring turns as it follows the cam. This turning aligns the locking lugs with the locking slots, thereby allowing the bolt to be extracted from the gun barrel. Obviously, when the motion is reversed, the bolt turns in the opposite direction, locking the bolt in place.

Figure 24:
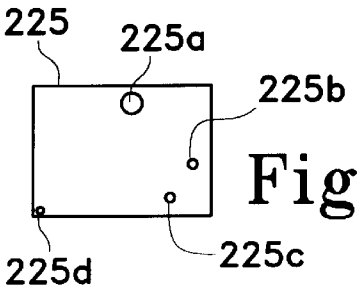
FIG. 24 is an end detail view of the pistol grip portion.
Figure 27:
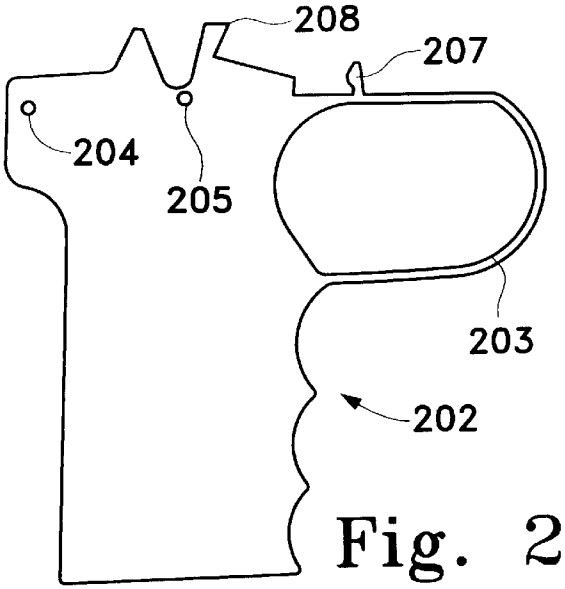
FIG. 27 is a front view of a mounting plate for the trigger, latch, hammer and tracking pins in the pistol grip of the second embodiment.

FIG. 27 shows a mounting plate 225. There are two plates used in this embodiment. FIG. 24 shows the position of the plate in a longitudinal placement to the handle. FIG. 21 shows the placement of the plate within the action of the gun. FIG. 27 shows that the plate 225 has several holes. These holes support pins that acts as pivots for various components. Hole 225*a* supports pin 226 on which the hammer 230 pivots. See FIGS. 21 and 23. Hole 225*b* supports pin 227, in which the pin 227 supports the locking latch 231. Hole 225*c* supports pin 228, which supports the trigger 232. Finally, hole 225*d* supports a pin 229 which acts a the forward guide for the inner grip form. This pin fits in hole 205 on that form. Note that all these pins are shown on FIG. 21.

Figure 28:
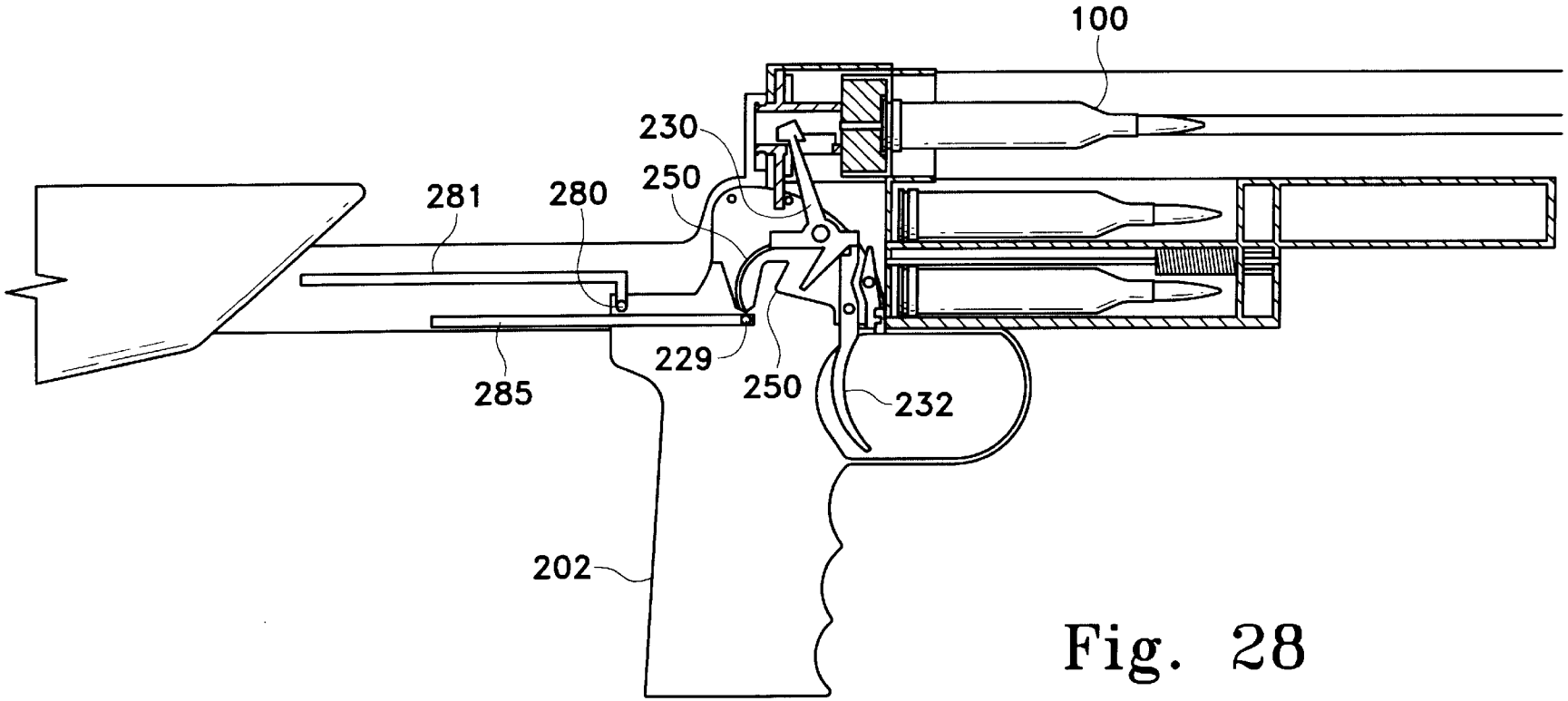
FIG. 28 is a side view of the action ready for firing.

FIG. 28 shows the bolt moved forward into the firing position. In this position, the pistol grip is rotated forward and upward into the standard firing position. Moving the pistol grip upwards and forward causes the bolt to turn in the barrel, thereby locking it in place for firing. In this view, the hammer 230 is restrained by the top of the trigger. Spring 250 is used to push the hammer forward for firing after the hammer is released by the trigger.

Figure 29:
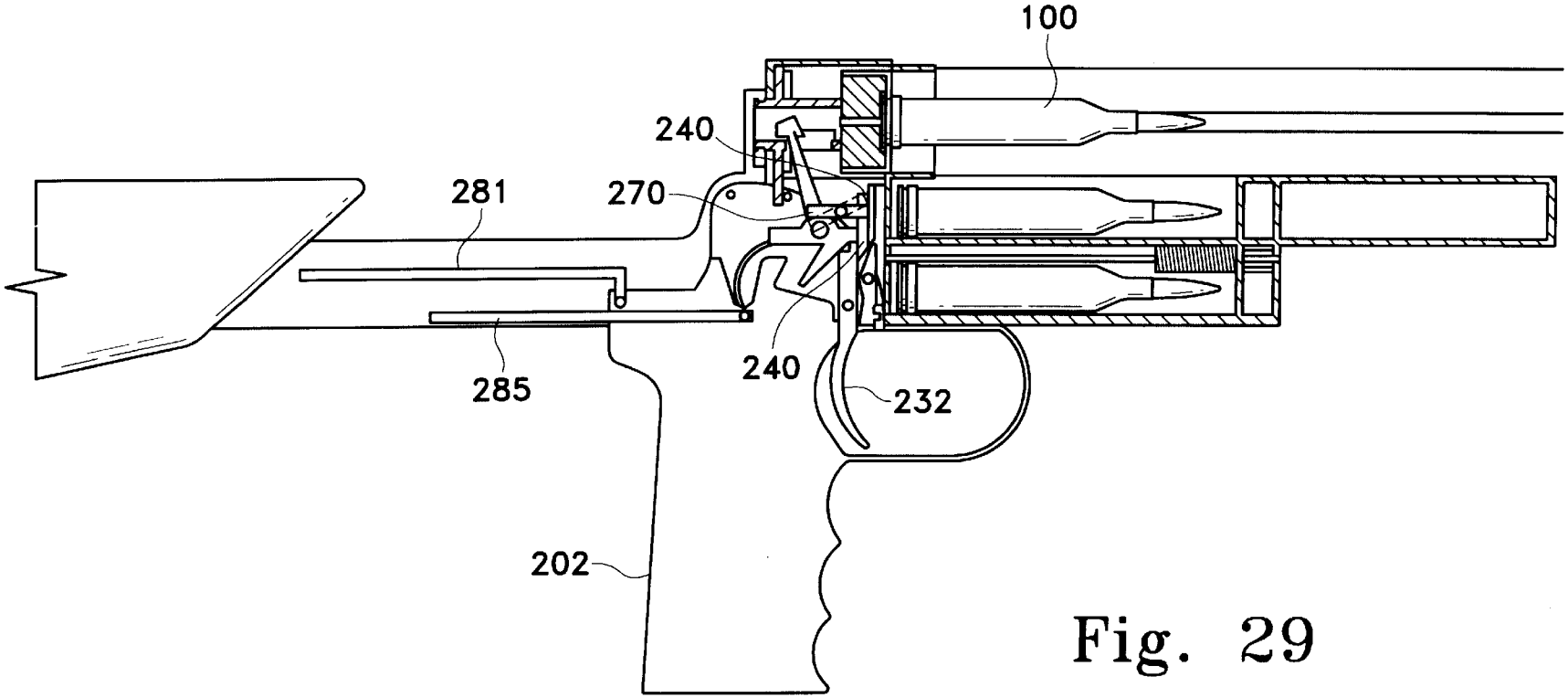
Figure 30:
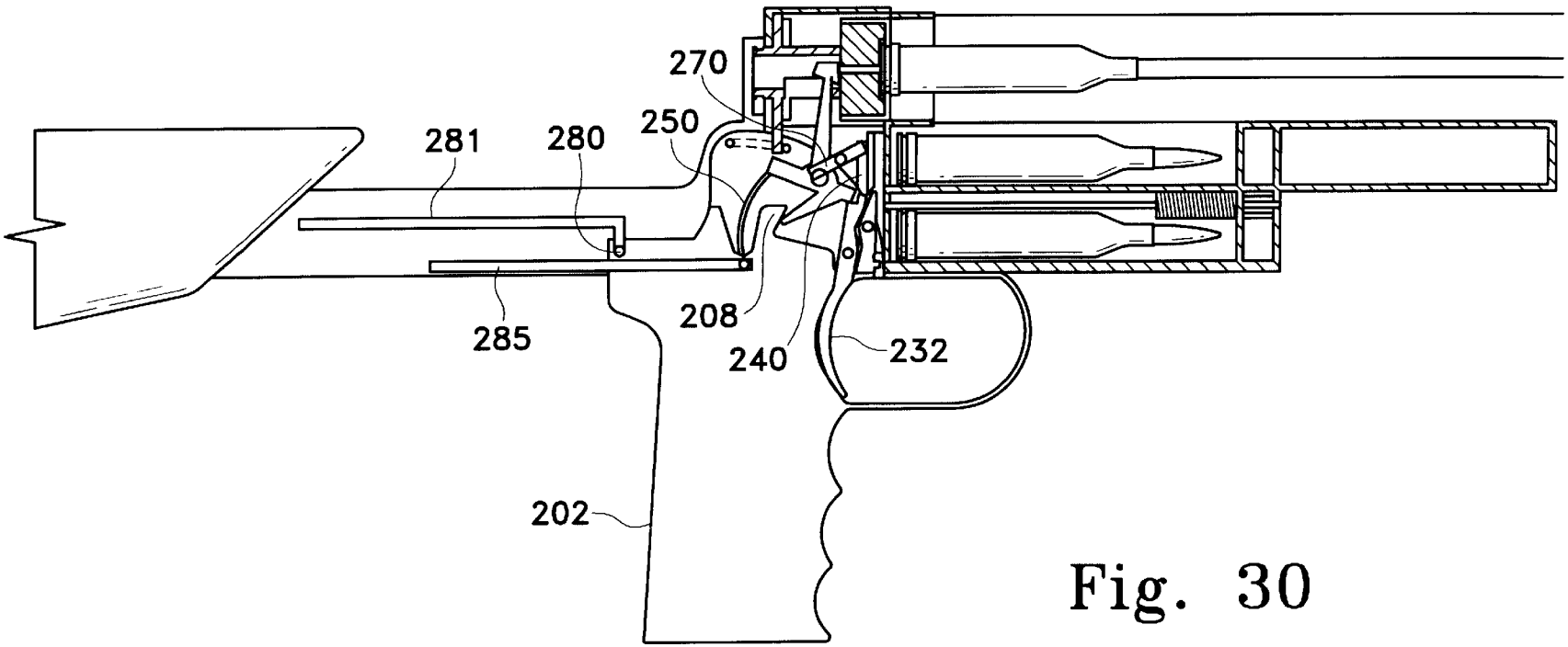
FIG. 30 is a side view of the action with the hammer having hit the firing pin.

FIG. 29 shows the second embodiment with the safety system in the on position. In this position, the trigger is locked and the gun cannot be fired. The safety system is identical to that described above, for the first embodiment. FIG. 30 shows the position of the safety lever 270 in the off position. In this position, the gun can be fired.

FIG. 30 shows the action just after the trigger has fired the gun. Here, the hammer is moved forward to strike the firing pin. This figure also shows that the trigger is moved almost full back against the grip. As shown, the second ear 208 of the inner grip form is in contact with the back of the hammer. The spring 250 is extended. The top of the trigger is resting against the locking latch 231. To open the action, the user must pull the trigger back slightly more. That causes the top of the trigger to press against the locking, latch 231. That causes the first ear 207 to be released by the locking latch. That in turn, permits the pistol grip to rotate downwards. Rotating the grip downwards does three things simultaneously. First, it rotates the bolt until the locking lugs align with the barrel lugs. Second, ear 208 pushes the hammer down until it cocks by resting in the notch at the top of the trigger. Third, it forces tracking pin 280 upwards until it aligns with the sliding track 281. Note that pin 229 rides in the sliding track 285. This restricts the amount of rotation of the pistol grip, to ensure proper operation. When pin 280 is aligned in track 281 the action can be slid backwards until it reaches the position shown in FIG. 21. As the bolt is moved back, the spent shell is ejected using the same equipment as described for the first embodiment, and a new shell from the magazine is moved up to the loading position, using the same techniques as that of the first embodiment. Once the new shell is in position, the action is slid forward until the bolt seats. At that point, the pistol grip is rotated forward and upward until the ear 207 locks in 13 place under the locking latch 231. At this point, the gun is ready for firing.

Third Embodiment

Figure 31:
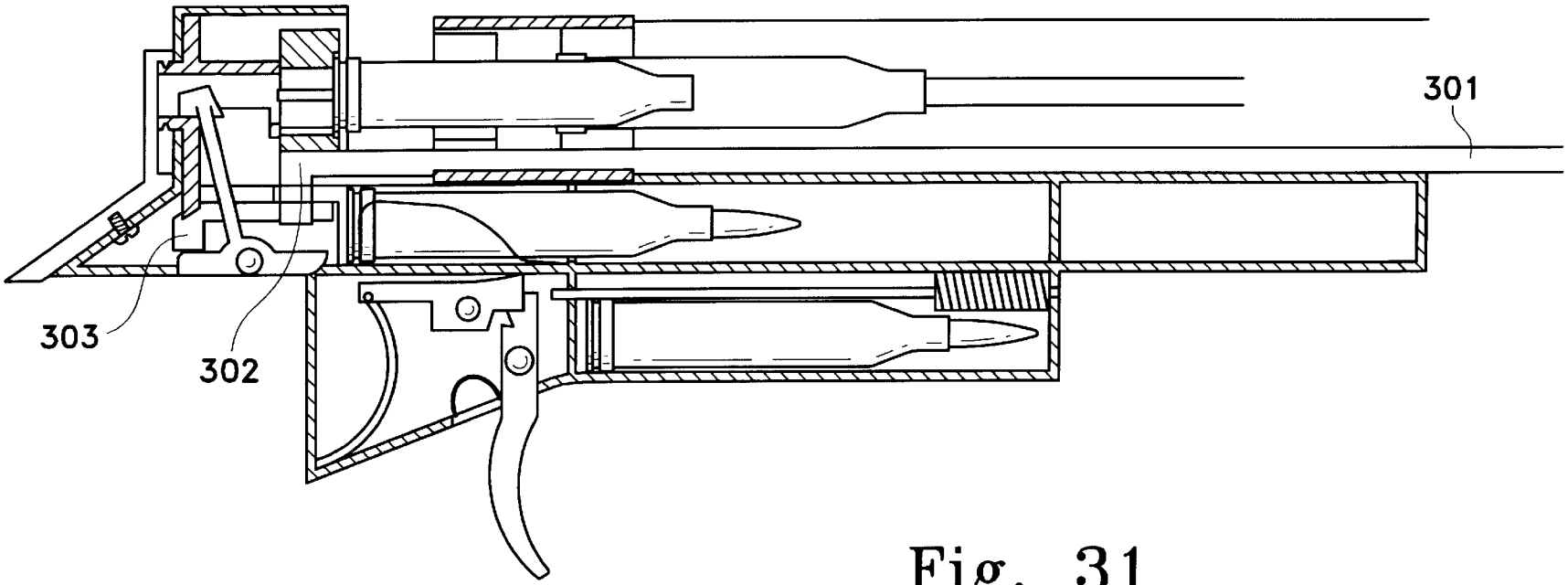
FIG. 31 is a side view of the third embodiment taken along the lines 31—31 of FIG. 32.

FIGS. 31–34 show details of the third embodiment. In this embodiment, the bolt action is automatic and is gas operated. FIG. 31 shows the side view of the rifle action. All of the parts are the same as in the first embodiment, except for the bolt lever, and the addition of a gas plunger tube. The gas plunger tube 301 is placed under the barrel in the manner common to the art. This plunger is the same type found on many automatic rifles available today. The end of the gas plunger fits into a recepticle in the lever 302. In this embodiment, there is no external bolt handle.

Escaping gas from the barrel pushes the lever 302 backward, rotating the gear rack 303 into the open position as before. The gas then pushes the bolt backwards, thereby causing the spent shell to be ejected and a new shell to be loaded as before. A return spring 304 pulls the bolt back into its closed position and causes the bolt to rotate back into the locked position. Once locked, the rifle is ready to fire. All other aspects and operations of the action are exactly as described above. The gas system only replaces the manual bolt lever. The actions need to turn it, pull it back, push it forward and to rotate it back into a locked position are the same as before. The only difference is the use of gas instead of a hand-operated lever.

Figure 34:
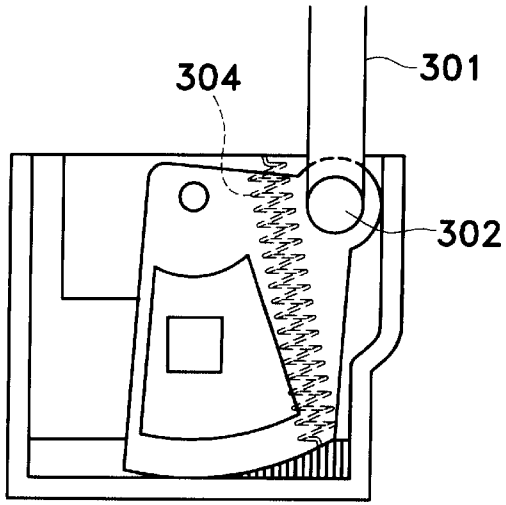
FIG. 34 is a top view of the bolt gears of the third embodiment with the bolt in the locked position.
Figure 33:
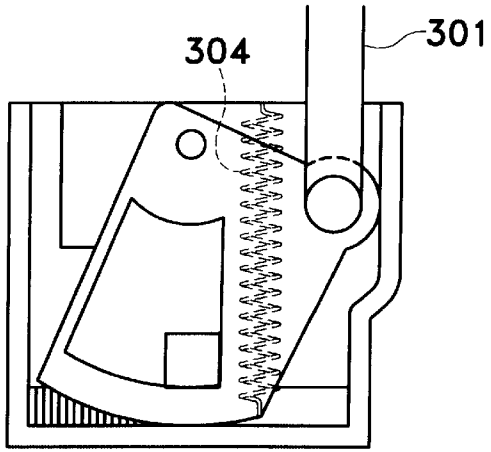
FIG. 33 is a top view of the bolt gears of the third embodiment with the bolt in the unlocked position.
Figure 32:
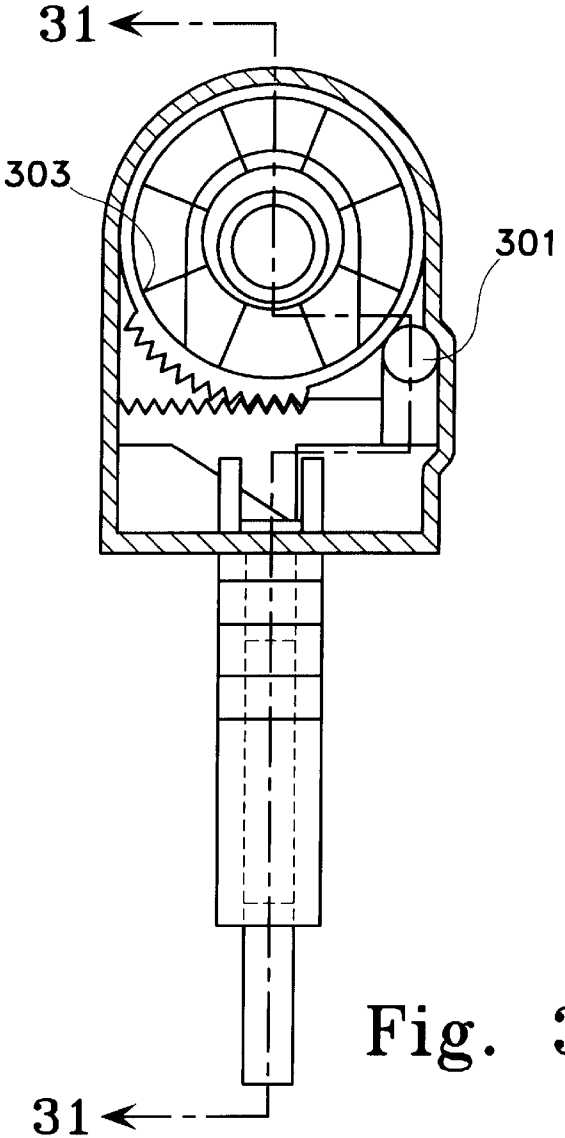
FIG. 32 is a front view of the bolt gears of the third embodiment with the bolt in the locked position.

FIG. 32 shows the front end of the bolt. FIGS. 33 and 34 show the top of the lever in the unlocked and locked positions. As discussed above, the plunger tube engages the lever as shown. The escaping gas forces the lever backwards, unlocking the bolt and pushing it back. The spring then pulls the lever forward into the locked position in a totally automatic process.

The present disclosure Should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A short-bolt rifle action, for a rifle having a barrel, comprising:

a) a bolt, said bolt having a first end and a second end, and further wherein the length of the bolt is about 1.35 inches;

b) a gear rack, fixedly attached to the second end of said bolt;

c) a slide, fixedly attached to said rifle;

c) a lever, slidably attached to said slide and being disposed below said bolt, said lever having a gear rack corresponding to the gear rack on said bolt, lever being pivotably disposed in said rifle action about a pivot point; and d) a means for pivoting said lever about said pivot point, whereby when said lever is pivoted, said gear rack on said lever engages the gear rack on said bolt, thereby causing said bolt to turn.

2. The short-bolt rifle action of claim 1 further comprising a means for locking and unlocking said bolt in said barrel.

3. The short-bolt rifle action of claim 1 further comprising a means for cocking a hammer, operably mounted to said short bolt rifle action.

4. The short-bolt rifle action of claim 1 whereby said means for pivoting said lever about said pivot point comprises a handle, extending outwardly from said lever.

5. The short-bolt rifle action of claim 1 whereby said means for pivoting said lever about said pivot point comprises:

a) an air tube, fixedly installed in said barrel for receiving a quantity of exhaust gas from said barrel, whereby said air tube is fixedly installed on said lever such that said quantity of exhaust gas from said barrel causes said lever to pivot when said quantity of exhaust gas is received in said air tuber; and c) a spring, attached to said lever to pivot said lever back after said quantity of exhaust gas has been dispelled from said short bolt rifle action.

6. A short-bolt rifle action, for a rifle, comprising:

a) a barrel, said barrel having a receiver and at least one locking groove from about said receiver;

b) a bolt, said bolt having a first end and a second end, and further wherein the length of the bolt is about 1.35 inches;

c) at least one locking lug, fixedly attached to the first end of said bolt, whereby said locking lug is operably disposed to engage in said locking groove in said barrel;

d) a gear rack, fixedly attached to the second end of said bolt;

e) a slide, fixedly attached to said rifle;

f) a lever, slidably attached to said slide and being disposed below said bolt, said lever having a gear rack corresponding to the gear rack on said bolt, lever being pivotably disposed in said rifle action;

g) a means for pivoting said lever, whereby when said lever is pivoted, said gear rack on said lever engages the gear rack on said bolt, thereby causing said bolt to turn about a longitudinal axis through a center of said bolt; and h) a means for sliding said lever back and forth on said slide.

7. The short-bolt rifle action of claim 6 further comprising a means for cocking hammer, operably mounted to said short bolt rifle action.

8. The short-bolt rifle action of claim 6 whereby said means for pivoting said lever includes a handle, extending outwardly from said lever.

9. The short-bolt rifle action of claim 6 whereby said means for pivoting said lever comprises a) an air tube, fixedly installed in said barrel for receiving a quantity of exhaust gas from said barrel, whereby said air tube is fixedly installed on said lever, such that said a said quantity of exhaust gas from said barrel causes said lever to pivot when said quantity of exhaust gas is received in said air tuber; and c) a spring, attached to said lever to pivot said lever back after said quantity of exhaust gas has been dispelled from said short bolt rifle action.

10. The short-bolt rifle action of claim 6 further comprising a safety mechanism, whereby when said safety mechanism is on, said rifle cannot be fired and when said safety mechanism is off, said rifle can be fired.

* * * * *